United States Patent [19]

Knorre et al.

[11] 4,126,446

[45] Nov. 21, 1978

[54] PACKAGES FOR THE STORAGE OF AIR AND MOISTURE SENSITIVE METALLURGICAL ADDITIVES AND THE USE OF SUCH PACKAGES

[75] Inventors: Helmut Knorre, Seligenstadt; Peter Leidl, Grossauheim, both of Germany

[73] Assignee: Deutsche Gold- und Silber-Scheideanstalt vormals Roessler, Frankfurt am Main, Germany

[21] Appl. No.: 679,421

[22] Filed: Apr. 22, 1976

Related U.S. Application Data

[63] Continuation of Ser. No. 337,984, Mar. 5, 1973, abandoned.

[30] Foreign Application Priority Data

Mar. 6, 1972 [DE] Fed. Rep. of Germany ..... 2210665

[51] Int. Cl.$^2$ ..... C21C 7/00

[52] U.S. Cl. ..... 75/53; 75/93 G

[58] Field of Search ..... 75/63, 58, 93 G, 135, 75/129

[56] References Cited

U.S. PATENT DOCUMENTS

| | | | |
|---|---|---|---|
| 2,086,756 | 7/1937 | Whitaker | 75/53 |
| 2,397,418 | 3/1946 | Howard | 75/93 G |
| 2,481,599 | 9/1949 | Kinzel | 75/93 G |
| 2,509,281 | 5/1950 | Tisdale | 75/93 G |
| 2,550,735 | 5/1951 | Tour | 75/93 G |
| 2,915,386 | 12/1959 | Strauss | 75/58 |
| 2,920,955 | 1/1960 | Goering | 75/58 |
| 3,681,050 | 8/1972 | Veki | 75/58 |
| 3,865,577 | 2/1975 | Gottschol | 75/58 |
| 3,881,937 | 5/1975 | Tuefel | 75/58 |
| 3,955,967 | 5/1976 | MacNamara | 75/58 |

*Primary Examiner*—P. D. Rosenberg
*Attorney, Agent, or Firm*—Beveridge, DeGrandi, Kline & Lunsford

[57] ABSTRACT

The use of a container in a metallurgical process, said container comprising two or more components which are clinched or crimped together, said container having contents which comprise an air, moisture, or air and moisture sensitive material, said use comprising introducing said container with its contents into a melt comprising at least one metal. The combination of the container and additive and an improved metallurgical process are also provided.

3 Claims, 1 Drawing Figure

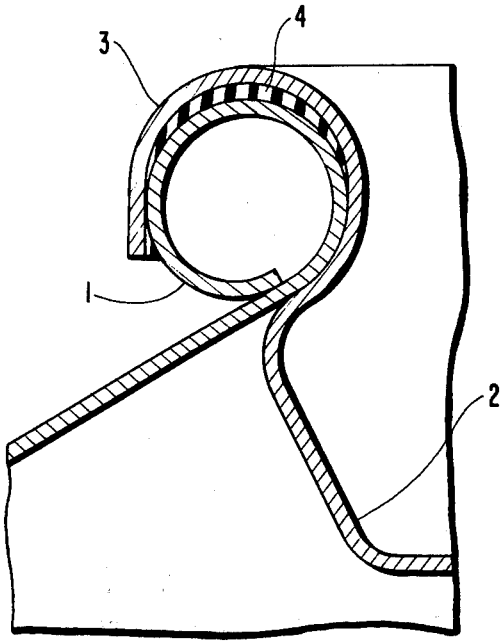
3
4
1
2

PACKAGES FOR THE STORAGE OF AIR AND MOISTURE SENSITIVE METALLURGICAL ADDITIVES AND THE USE OF SUCH PACKAGES

This is a continuation, of application Ser. No. 337,984 filed Mar. 5, 1973, now abandoned.

This invention relates to packages for air and moisture sensitive metallurgical additives, the use of such packages, and an improved metallurgical process in which the package and its contents are added to a melt. More particularly, the package is a container comprising two or more components which are clinched or crimped together and the container has contents which comprise the air and moisture sensitive additive.

In metallurgy, alkali metals are used as additives to metals or alloys. Thus, for example, in the production of the so-called silumin alloys, metallic sodium is added to a molten silicon/aluminum alloy. The sodium refines the crystalline structure of the alloy, as a result of which the mechanical properties of the alloy are improved.

The addition of a lumpy, unprotected alkali metal into a metallurgical melt is not possible, since the alkali metal, because of its low specific gravity, remains on the surface of the melt, and will ignite there. Also, the metal must be as free as possible of oxide impurities, since, for example, NaOH or $Na_2CO_3$ cause changes in an aluminum containing melt. This results in a lowering of the quality of the alloy.

Such air and moisture sensitive metallurgical additives have been packed and stored in so-called beaded (flanged) cans made of aluminum. The additive, including the can, are added to the metallurgical melt. Beaded cans consist of a cylindrical container, on which a lid is flanged by means of at least one pair of rollers, attaching inside and outside on the edge of the lid. When using such cans for packing, for example, alkali metals, the tightness, especially of smaller flanged cans, is not usually sufficient to protect the highly sensitive packaged material from air and moisture for a prolonged time.

One reason for the imperfect closure of smaller cans, such as those having a diameter of about 35 mm. or less, is the sharp curvature of the wall of the can and from the point of view of finishing techniques, to achieve a satisfactory tightness of the can.

Penetration of air and moisture into a flanged can containing sodium leads to the formation of caustic soda, and thus to corrosion of the material of the can which is generally sensitive to alkali; for example, aluminum cans are quickly "corroded through" and a single spoiled can, can "infect" all cans within a packaging unit comprising several cans.

Thus, there exists a need in the art for a long-lasting, hermetic package for air and moisture sensitive additives, which together with the additive packed in it can be added to metallurgical melts, without contaminating the melt in any way.

Accordingly, this invention aids in fulfilling this need. This invention provides for the use of a container in a metallurgical process. The container comprises two or more components which are clinched or crimped together. The container has contents which comprise an air, moisture or air and moisture sensitive material. The use comprises introducing the container with its contents into a melt comprising at least one metal.

This invention also provides, in combination, a metallic container and its contents. The metallic container is comprised of two or more aluminum components which are clinched or crimped together. The contents of the container are selected from the group consisting of sodium, lithium, sodium monoxide, phosphorus penta-chloride and phosphorus pentoxide. The metallic container is hermetically sealed using conventional techniques. Additionally, this invention provides an improved metallurgical process in which a sensitive material is added to a melt. The sensitive material is one which is air, moisture, or air and moisture sensitive. The melt comprises at least one metal. Specifically, the improvement comprises a container having two or more components which are clinched or crimped together.

The FIGURE is a detailed view of the upper limit of the container having the lid clinched thereto.

According to a preferred embodiment of this invention, the container is metallic, and the metal of the container is the same as a metal in the melt of metals to which it is to be added.

The clinched or crimped cans employed in this invention are generally fabricated by clinching or crimping a lid portion over an upper and/or lower rolled edge of the upper or lower limit of a container. This will be apparent from the FIGURE. The rolled edge can be inside or outside the container. In the FIGURE, rolled edge 1 is shown outside the container. The lid 2 is clinched or crimped over rolled edge 1 as shown at 3. As a result of this construction, the material of the container and its lid come into close contact. Thus, it will be understood that an elastic seal 4, such as rubber, can be injected or inserted between the contacting surfaces of the container and its lid.

Heretofore, clinched or crimped containers have generally only been used for packaging sprays, for example, cosmetic sprays. The new use of these containers in the field of metallurgy makes it possible to eliminate in a simple manner a problem which lead again and again to the loss of material, production breakdown and potential hazards in storage areas.

Persons skilled in the art will immediately recognize that the possible areas of application within the technical arts are manifold. Besides being useful for packaging alkali metals, such as sodium or lithium in clinched or crimped cans made from aluminum, for the refinement of silumin alloys, the following additional applications can be mentioned.

Use of alkali metal filled aluminum cans for the dearsenification of zinc;

Use of aluminum cans filled with sodium monoxide, $Na_2O$, as an additive to silumin alloys and for the dearsenification of zinc;

Use of aluminum cans filled with phosphorus pentachloride, $PCl_5$, as an additive to silumin alloys.

This invention is particularly advantageous in that it permits the storage and use of even small quantities of additives in hermetically sealed containers. For example, there can now be safely stored, transported and processed individual units comprising about 12.5–500 grams of additives for metallurgical processes. These small quantities are of particular interest in alloying processes, particularly when the additive is an alkali metal, such as from Group IA of the Periodic Table.

This invention is particularly adapted to situations in which the volume of the additive to the metallurgical process is relatively small, and the volume of the container in which the additive is packaged is about 35 mm. in diameter or smaller. It will be apparent to those skilled in the art that the container need not be cylindrical in shape provided the parts can be clinched or crimped to form a hermetic seal.

What is claimed:

1. In combination a metallic container comprised of two or more aluminum components that are secured together said container having an upper limit and a lower limit, either or both of said upper limit and said lower limit being open; a lid means for closing each of said openings; said container having contents selected from the group consisting of sodium, lithium, $Na_2O$, $PCl_5$ and $P_2O_5$; each of said lid members being clinched or crimped over a rolled edge of said container at each of said openings in said container in order to hermetically seal said container and thereby seal said contents against air moisture.

2. In combination, a metallic container as defined in claim 1 having an elastic seal between contacting surfaces of said container and said lid.

3. In combination, a metallic container comprised of two or more aluminum components that are secured together, said container having an upper limit and a lower limit, either or both of said upper limit and said lower limit being open, a lid means for closing each of said openings, an elastic seal between said contacting surfaces of said containers and said lid, said container having a diameter of up to about 35 mm, said container having contents selected from the group consisting of sodium, lithium, $Na_2O$, $PCl_5$ and $P_2O_5$ and wherein the contents comprise 12.5 to 500 gms, where such container is cylindrical in shape, said lid means hermetically sealing means and container being arranged so that the lid is clinched and crimped over the rolled edge of the container at each of the openings in the container to thereby seal the contents against air and moisture and to protect the contents thereof which are air and moisture sensitive additives for a metallurgical melt.

* * * * *